US006976566B1

(12) United States Patent
Skriloff

(10) Patent No.: US 6,976,566 B1
(45) Date of Patent: Dec. 20, 2005

(54) NESTED WHEELED LUGGAGE ASSEMBLY

(76) Inventor: Allan Skriloff, 345 Abbey Rd., Mt. Tremper, NY (US) 12457

( * ) Notice: Subject to any disclaimer, the term of this patent is extended or adjusted under 35 U.S.C. 154(b) by 148 days.

(21) Appl. No.: 10/624,214

(22) Filed: Jul. 21, 2003

Related U.S. Application Data

(60) Provisional application No. 60/399,238, filed on Jul. 29, 2002.

(51) Int. Cl.[7] ..... A45C 5/14; A45C 5/06

(52) U.S. Cl. ..... 190/18 A; 190/102; 190/108; 206/287.1; 280/37

(58) Field of Search ..... 190/9, 10, 15.1, 190/18 R, 102, 108, 109.11; 280/37, 47.17, 280/47.26; 206/287, 287.1, 286; 383/37

(56) References Cited

U.S. PATENT DOCUMENTS 1,062,496 A * 5/1913 Paler ..... 190/7
1,655,884 A * 1/1928 Wood ..... 190/9
2,453,663 A * 11/1948 Hinson ..... 190/100
3,315,772 A * 4/1967 Katz ..... 206/287.1
3,869,034 A * 3/1975 Thornton, Jr. ..... 190/13 R
4,436,189 A * 3/1984 Baum ..... 190/108
4,598,803 A * 7/1986 Ghiassi ..... 190/108
4,693,368 A * 9/1987 King et al. ..... 206/287.1
4,998,603 A * 3/1991 Nordstrom ..... 190/18 A
5,113,982 A * 5/1992 Pulichino et al. ..... 190/18 A
5,547,052 A * 8/1996 Latshaw ..... 190/108
6,076,641 A * 6/2000 Kinzer et al. ..... 190/18 A
6,471,019 B1 * 10/2002 Miller ..... 190/11
6,585,090 B2 * 7/2003 Harvey ..... 190/108

* cited by examiner

*Primary Examiner*—Sue A. Weaver
(74) *Attorney, Agent, or Firm*—Schweitzer Cornman Gross & Bondell LLP

(57) ABSTRACT

A nested wheeled luggage assembly comprises an inner core luggage member and an outer, wraparound garment carrier hingeable about a central horizontal axis. The inner core luggage member includes two open storage shells hinged on the axis and also about their peripheries, and at least one pair of support wheels, and a retractable-extendable handle mounted on one shell whereby the core luggage member may be independently transported. An outer, wraparound garment carrier is foldable about a central horizontal axis and includes at least one pair of spaced support wheels and a telescopically retractable pull handle. The outer carrier is of equal width but substantially longer than the core luggage member, whereby the outer carrier may be folded over the core carrier in closely engaging relation. Locking straps are deployed at the periphery of the outer carrier to secure the outer carrier in a folded relation over the core carrier in a manner enabling the outer and inner carriers to be transported as a single unit.

2 Claims, 7 Drawing Sheets

NESTED WHEELED LUGGAGE ASSEMBLY

This application claims the benefit of Provisional Appl. No. 60/399,238, filed Jul. 29, 2002.

BACKGROUND OF THE INVENTION

The present invention is directed to wheelable luggage in general and a combined luggage assembly including an inner core luggage member having two clamshell members which may be zipped together to form a compact piece of luggage which includes a telescopic pull handle and wheels as well as an outer foldable garment carrier also having a telescopic handle and wheels which may be deployed over the inner luggage core member and affixed thereto in a manner whereby the assembly may be handled as a unitary piece of luggage.

SUMMARY OF THE INVENTION

In accordance with the principles of the present invention, the two components of the luggage assembly, namely an inner clamshell core member and the outer foldable garment carrying member, may be used independently of one another, that is to say each may be carried and used as a separate piece of luggage or they may be combined and used as a unitary piece of luggage for transport. Upon arrival at a destination the two combined pieces may be separated and hung in a closet, as will be explained hereinafter.

The inner core member comprises two luggage portions which are hinged along a common horizontal axis for opening and deployment by hanging in a closet. For transport the two clamshell members are folded along their common hinge and zipped together by an appropriate slide fastener such as a zipper or, alternatively, they may be fastened together by mechanical means including mating Velcro strips (hook and loop fastening tapes) or other mechanical hasps or fasteners. In accordance with a more specific aspect of the invention, each of the clam shell luggage portions has a pair of foldable shelves therein, which fold out to form horizontal shelves when the luggage is opened and deployed for either packing of garments or retrieval of garments.

The outer garment carrier, in accordance with the invention, is substantially longer in its open deployed position than the length of the core luggage member when it is unfolded and hung. The outer garment carrier therefore may be folded about and secured to the inner luggage member so that the two pieces, which may be used independently, may be transported as a single unit. Of course it is to be understood that each of the units forming a component of the luggage assembly may be used independently of the other.

For a more complete understanding of the construction of the luggage assembly of the present invention and for a better appreciation of the attendant benefits of the present invention, reference should be made to the detailed description taken in conjunction with the accompanying drawings.

DETAILED DESCRIPTION OF THE INVENTION

Figure 1:
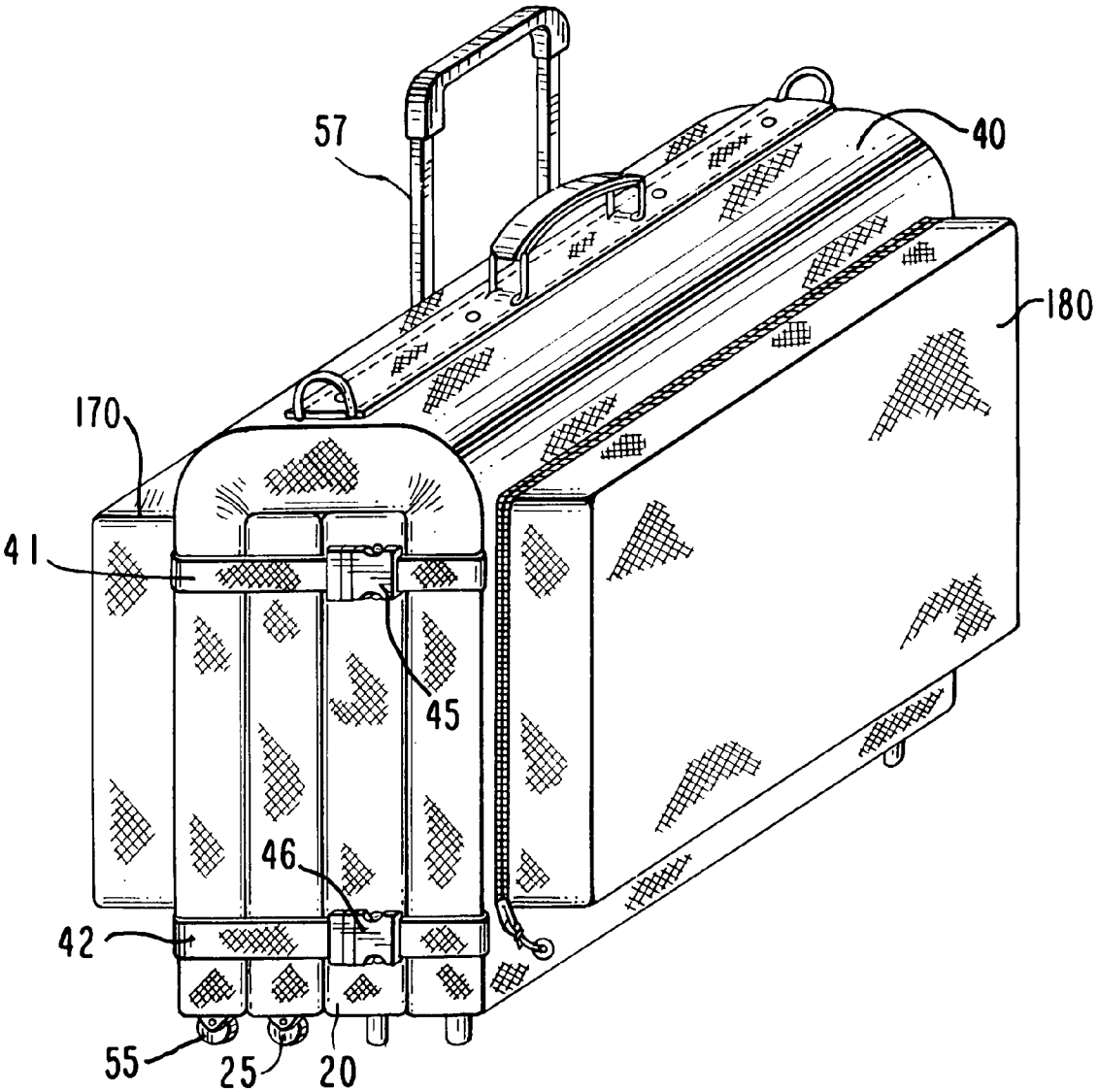
FIG. 1 is a perspective view of the combination outer garment carrier and inner core luggage member attached to one another for transportation as a single unit.

Referring now to FIG. 1, the combined luggage assembly of the present invention includes an inner core luggage member 20 surrounded by a wraparound outer folded garment carrier 40. The outer garment carrier 40 includes a plurality of adjustable fastening straps 41, 42 attached to side edges of the garment carrier, which include male locking tongues 43, 44 which are adapted to engage mating female locking members 45, 46 respectively of straps 47, 48 as shown for example in FIG. 6. The straps 41, 42, 47, 48 may be adjusted so that the garment, carrier is tightly clamped about the core luggage member 20 as shown in FIG. 1. The ends of the wraparound garment carrier 40 are tightly fastened against the lower portion of the luggage by fastening straps 49, 50 which are connected to straps 51, 52 along the bottom of the luggage assembly as will be understood. Thus six straps tightly secure the wrapped-around outer luggage carrier 40 to the inner luggage member, two straps on each end of the inner core luggage member and two at the bottom.

Figure 2:
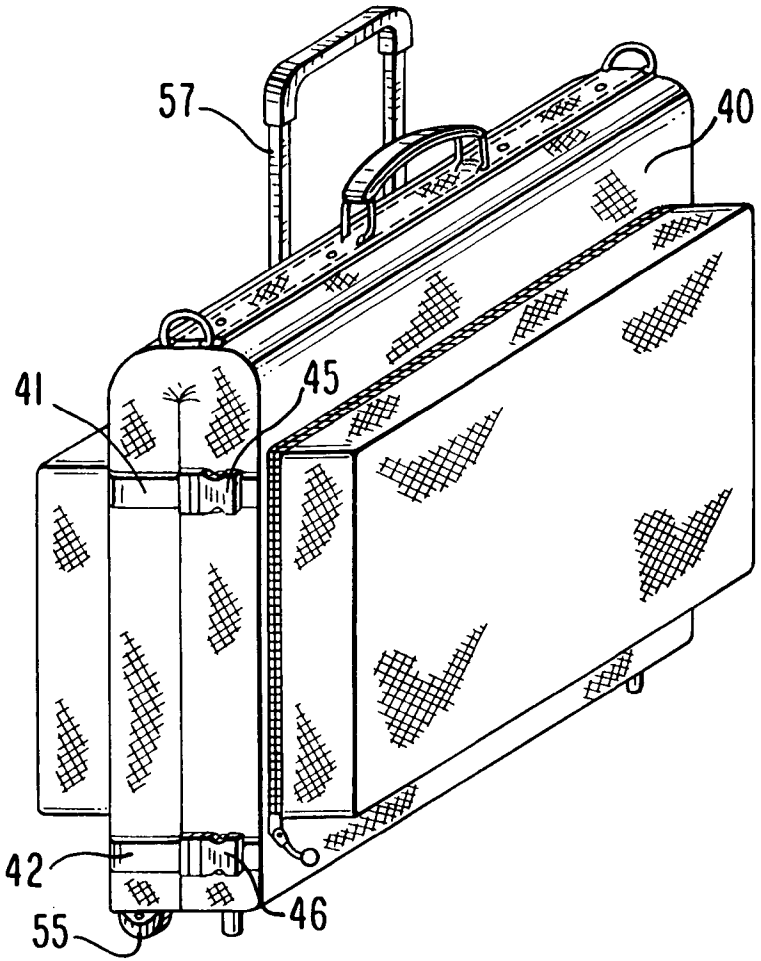
FIG. 2 is a perspective view of the outer garment carrier folded for use independently of the inner member.

In accordance with the invention, the straps 41, 42 and 49, 50 may be effectively shortened and they may be fastened one to the other with the garment carrier folded as shown in FIG. 2 in a manner excluding the inner luggage member 20 so that the garment carrier may be used independently as a single piece of luggage.

Figure 3:
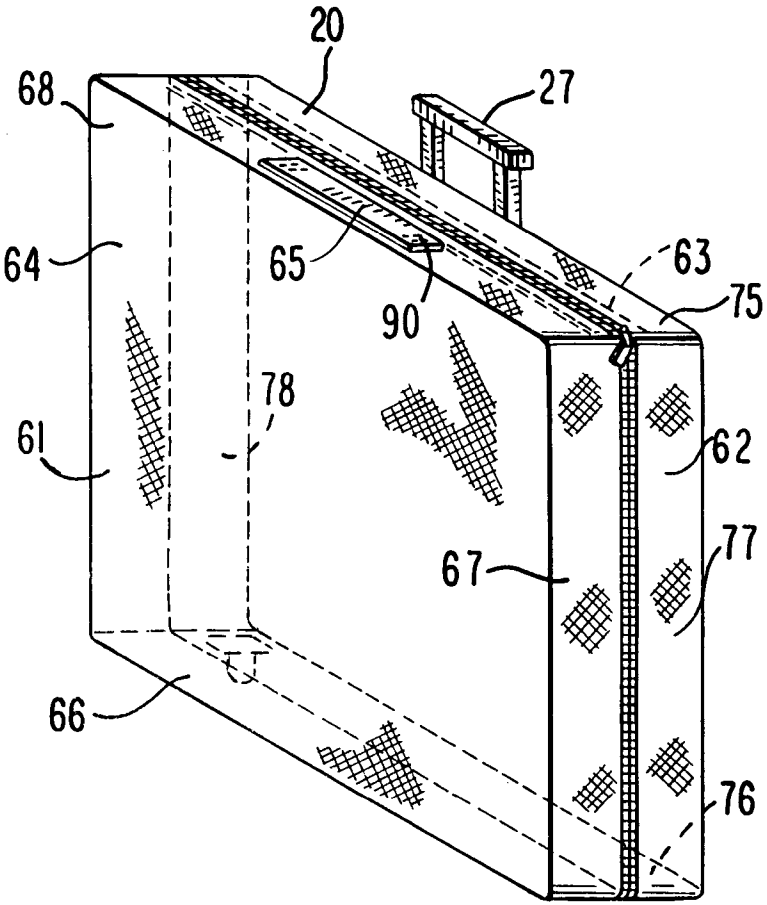
FIG. 3 is a perspective view of the inner luggage member folded and attached to form a single luggage unit, which may be used and transported independently of the outer garment carrier.

Similarly, the inner luggage core member 20 as shown in FIG. 3 may be used independently of the outer garment carrier 40.

To the end of making each of the inner luggage member 20 and the outer garment carrier 40 independently and readily transportable in accordance with the principles of the invention, each is provided with an appropriate telescoping handle member and associated wheels. More specifically, as shown in FIGS. 1 and 2, the outer luggage carrier includes a pair of spaced wheels 55 supported in bearing brackets 56. A retractable telescoping pull handle 57 is supported in tubes (not shown) adhered or fastened directly to an outer surface of the garment carrier 40 in known fashion. Thus the garment carrier, when being used independently as shown in FIG. 2, may be wheeled along a walkway by deploying the pull handle 57 and pulling the luggage on the wheels 55. When the core member 20 is connected directly to the carrier 40 as shown in FIG. 1, both the core member and the luggage carrier may be similarly wheeled along the wheels 55 by deployment of the handle 57. Hence when the inner core member 20 is itself being used independently it may be wheeled along wheels 25 attached to one of the clamshell members of the inner core member by a bearing bracket 26. A deployable retractable handle 27, similar in construction to the handle 57 is supported in tubes 28 secured to the outer wall of the core member 20 by mechanical fasteners (not shown).

Thus it is to be understood that a fundamental aspect of the present invention provides independently usable wheeled luggage pieces which may be quickly and conveniently fastened together to form a single toteable, wheelable luggage unit.

Figure 4:
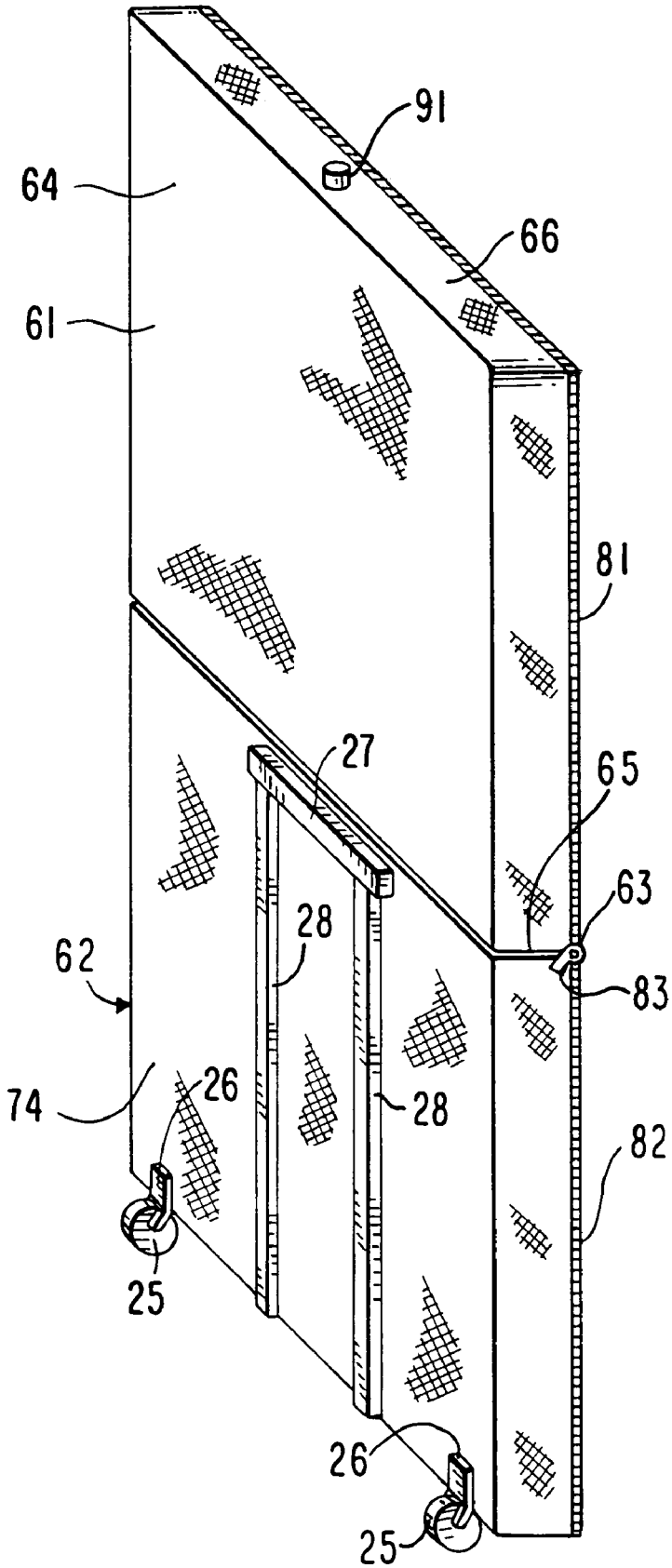
FIG. 4 is a perspective view of the inner luggage member with the two clamshell halves hinged upon one another to fully open the luggage member.
Figure 5:
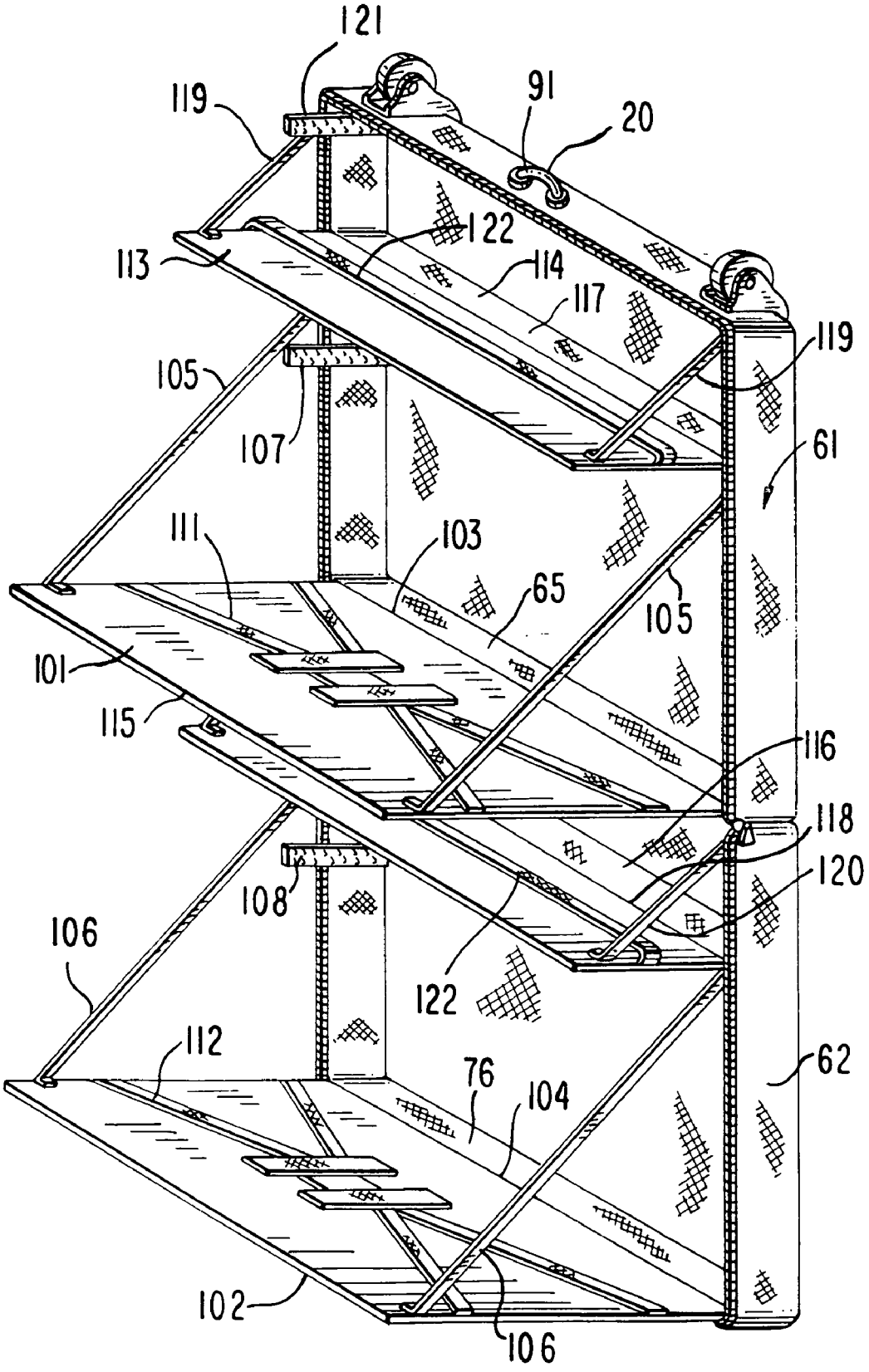
FIG. 5 is a perspective view of the inner core member of FIG. 4 with the foldable shelves deployed into their horizontal position for either packing or unpacking of the unit.

Specifically, the inner core luggage member 20 as shown in FIGS. 4 and 5 comprises an upper clamshell portion 61 and a lower clamshell portion 62 which are hinged together by a fabric hinge 63 extending across the full width of the clamshells 61 and 62. More specifically the clamshell member 61 is five-sided, as is the clamshell member 62. The member 61 includes an outer wall panel 64 and a top panel 65 and a bottom panel 66 which are connected together by side panels 67, 68. The clamshell member 62 similarly to the member 61 has an outer wall 74, a top wall 75, a bottom wall 76, and side walls 77, 78. The five walls comprising each of the clamshells 61, 62 may be made from conventional soft luggage fabric, including nylon, canvas, leather, or any other treated plastic material which may be stitched or welded into a generally box-like or parallelepiped form such as shown in FIG. 4, in accordance with standard luggage making techniques. The fabric hinge 63, as shown in FIG. 3 in phantom, extends for the full width of the luggage member 20 and hinges the top walls 65, 75 of the clamshells 61, 62.

The remaining sides of the clamshells 61 and 62 in accordance with the principles of the invention include zipper or slide fastener tracks 81, 82 extending around the periphery of each of the clamshells from the edge of the hinge on one side to the edge of the hinge on the other side. A slide fastener 83 is adapted to connect, by slide fastening or zipping, the tracks 81 and 82 when the clamshells are closed and abutted in a luggage closing position shown in FIG. 3. The core member 20 in addition to the pull handle 27 also includes a simple handle 90 which may be suitably fastened to the panel 65 as shown in FIG. 3. Advantageously, the handle 90 is a flexible, recessed strap member which may be flattened into the outer profile of the core member so as not to take up undue space when the core member 20 is surrounded by the outer garment carrier 40 as shown in FIG. 2.

The clamshell 61 also includes a metal ring or suspension bracket 91 secured to the wall 66 as shown in FIG. 4.

Thus the luggage member 20 may be opened for hanging in the nature of a garment carrier, for example, by unzipping the zipper tracks 81 and 82 by the slide fastener 83 and hinging the clamshells 61 and 62 about the fabric hinge 63 to deploy the clamshell 61 immediately above the clamshell 62 and in line therewith in a manner whereby the hardware 91 which may include a hook (not shown) may be hung over a closet rod.

In accordance with the invention, the clamshells 61 and 62 contain two full-width shelves which are formed therein and which may be closed after the luggage is packed with clothing and then opened when the luggage is suspended in a closet.

As shown in FIG. 5, the clamshells 61 and 62 have full-width shelving members 101, 102 hinged to the clamshell walls 65 and 76 by full-width fabric hinges 103, 104. The shelf members 101, 102 thus may be hinged into and out of clamshell closing positions parallel with the outer clamshell walls 64 and 74 as will be understood. Flexible cords 105 and 106 extending between the shelf members 101 and 102 and the side walls of the clamshells support the shelves in their deployed horizontal positions as shown in FIG. 5 and accommodate the folding of the shelves into clamshell closing positions as described hereinabove. With the shelves folded into a closed position, the shelves may be maintained in the closed position by Velcro locking strips 107, 108, which adhere to the inner side walls of the clamshells as shown in FIG. 5 and which engage mating Velcro strips on the exposed surfaces of the shelves 101 and 102 in a clamshell closing position, as will be understood. The shelves 101 and 102 further include flexible elastic hold-down straps 111 and 112 in known fashion. As will be understood, the shelves 101 and 102 when deployed in an open position are in the planes of the panels 65 and 76 and cooperate therewith to form a single planar support surface for items' to be packed. Similar shelves, but shorter in length than the shelves 101 and 102 are deployed above each of the shelves 101 and 102 as shown. These shelves 113 and 115 cooperate with full-width shelf members 114 and 116 to which they are fastened by fabric hinges 117, 118. These shorter shelves are similarly supported in horizontal planes in the manner of the shelves 101, 102 by nylon cords 119, 120 extending between the shelves 113 and 115 and the clamshell sidewalls, as shown best in FIG. 5. The shorter shelves, in a closed position, may be secured parallel to the outer clamshell walls by locking Velcro strip 121 as will be understood. Flexible hold-down straps 122 are included with the shorter shelves for the purpose of securing packed clothing thereagainst.

Thus it will be understood that to fill the inner core member 20 with clothing it may be hung up in a closet in the open position shown in FIG. 205 with the four shelves deployed as shown. Items to be stored may be placed on each of the four shelves as shown, under the straps to hold the clothing in place. Thereafter the four shelves may be hinged upwardly along their fabric hinges into a clamshell closing position in which each of the Velcro straps may be deployed to fasten the shelves in a clamshell closing position. The packed clamshells may be hinged about the fabric hinge 63 to place the zipper tracks 81, 82 in proximity to one another, whereafter the slide 83 may be tracked or zippered about the circumference to lock the clamshells closed one to the other. The fully packed luggage member then may be moved independently by deploying handle 27 and rolling it along rollers 25.

In accordance with the principles of the invention, the inner core member may be assembled with the outer wrap-around garment carrier.

Figure 6:
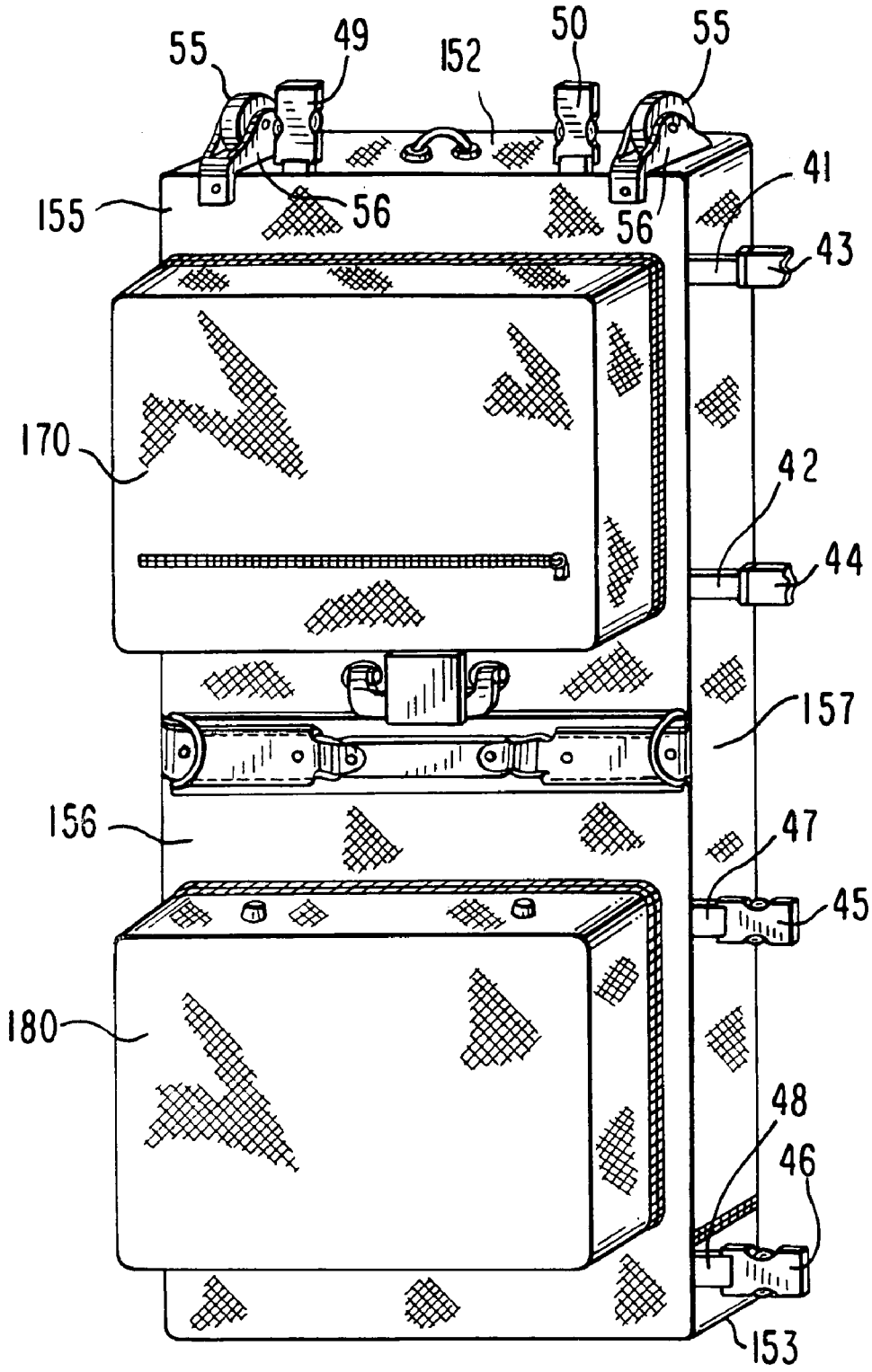
FIG. 6 is a perspective view of the unfolded garment carrier of FIG. 2 showing attached removable compartments on the outer wall thereof.
Figure 7:
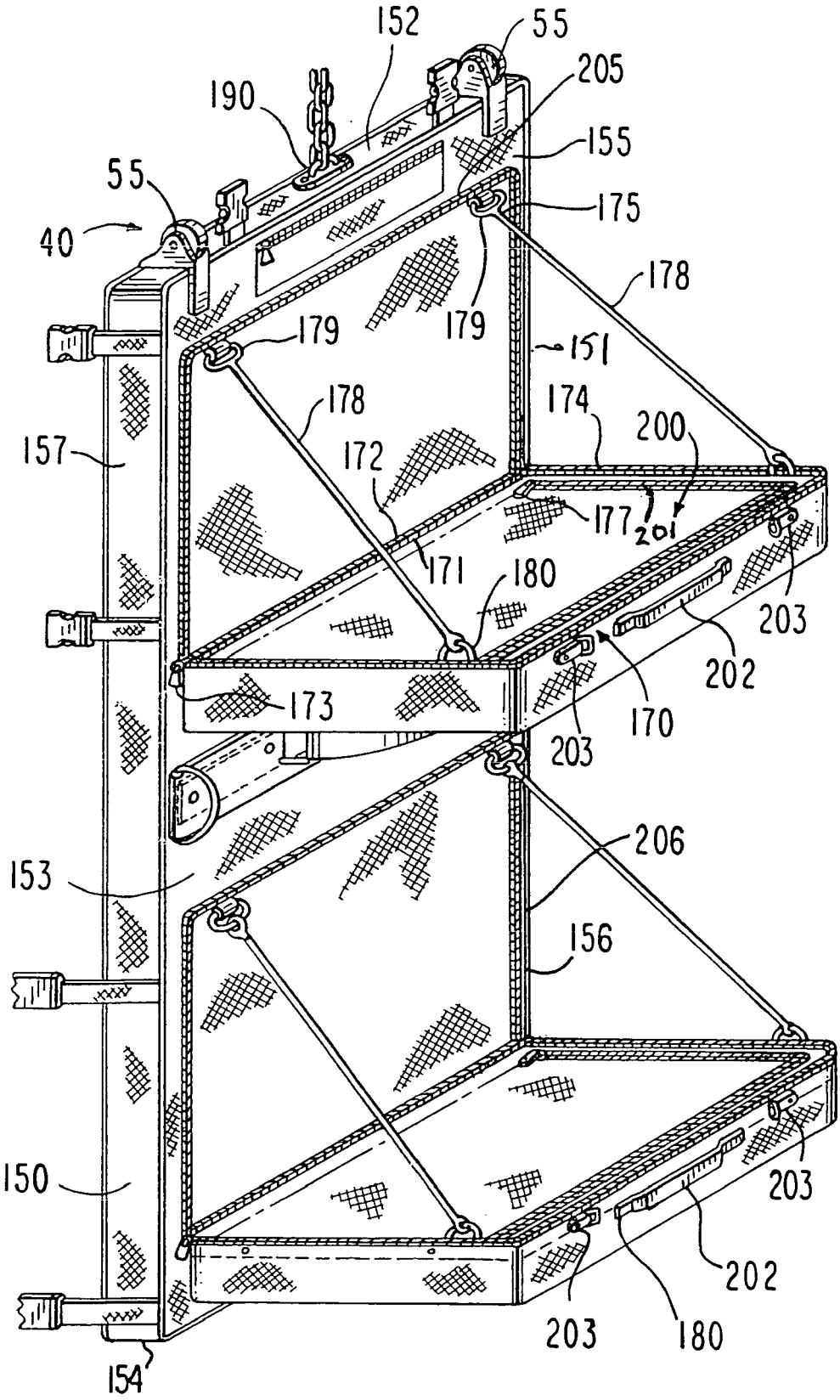
FIG. 7 is a perspective view of the garment carrier with the outer compartments shown in FIG. 6 opened and hinged into a horizontal shelf-forming position.

As shown in FIGS. 6 and 7, the garment carrier 40 is of generally conventional garment carrier configuration and assembly, namely having opposed side walls 150, 151. The side walls 151, 150 are interconnected, by a bottom wall 152 extending therebetween and a top wall 153.

In accordance with the invention, the length of the top wall 153 is sufficient to permit the luggage carrier 40 to wrap around the closed inner core luggage member 20 in the manner shown in FIG. 1. A second bottom wall 153, shown in FIGS. 6 and 7, is included. The outer wall of the luggage carrier includes the central portion 153 as well as portions 155 and 156. On the opposite side of the walls 153, 155, 156 there is a conventional garment carrier closure wall 157 which has a D-shaped zipper closure 210 extending across the top and bottom and for the substantial full length of the carrier wall 157 for access to the interior body portion of the garment carrier 40. This construction is well known to the luggage art. Advantageously integral zippered pouches 190, 191 or pockets are included in the panel wall 157.

As a specific advantageous feature of the present invention, the wraparound luggage carrier 40 includes a pair of outer hingeable parallelepiped carrier members 170, 180 which are adapted to be removable from the carrier body itself by totally circumscribing zip fasteners 205, 206 as shown in FIGS. 6 and 7. More specifically, the compartment 170 may be hingedly connected along a horizontal axis zipper formed by a pair of slide fastener track portions 171, 172 which are connected by a slide 173. Track portion 172 is sewn onto the wall 155 of the carrier. Thus the hinge axis formed by the cooperation of the slide track portions 171, 172 may be disrupted and the compartment 170 may be removed in its entirety from the luggage carrier. Alternatively, when it is hinged to the carrier by the tracks 171, 172, it may be closed by connection of the remaining track portions 174, 175 which along with positions 171, 172 entirely circumscribe the compartment 170. The compartment 170 is separately closed by a panel 200 hinged thereto beneath the track 171. The panel 200 is attached by zipper 201 to the remaining three walls of compartment 170 by a zipper slide 177.

The compartment 170, in accordance with the invention, may be deployed in a shelf-like fashion from the garment carrier by cords 178 extending between loops 179 fastened to the wall 155 and loops 180 fastened within the compartment 170 as shown. The lower compartment 180 is identical in all respects to the compartment 170, having similar circumscribing zip-fastening closures and nylon rope support of the compartment 180 when in an open position. In accordance with the invention the compartments 170, 180 may be completely removed from the garment carrier by completely unzipping the circumscribing slide fasteners 205, 206. Each compartment may be used independently (by way of handles 202 and/or shoulder straps (not shown) attached to loops 203 attached to the compartments 170, 180. Alternatively and as a further aspect of the invention, the circumscribing zipper tracks sewn on each of the removable compartments are mateable so that the removed compartments 170, 180 may be fastened together along their peripheral edges to form a single piece of luggage.

It will be understood that the garment carrier 40 may be suspended in a closet in its open position for packing and/or removing of clothing in known fashion. To that end, a hanger hook 190 is included on the garment wall 152. The items to be stored or retrieved in the compartments 170, 180 are simply packed therein and the compartments are hinged about the zippered axis 171, 172 and closed securely by then closing the circumscribing zipper tracks 174, 175. To retrieve the clothing and open the compartments in a shelf-like fashion, the process is simply reversed.

When the garment carrier 40 is fully packed, it may then be wrapped around the packed inner core member 20 and fastened thereto by the connection of the straps 41, 42, 43, 44, 45, 46, and 49, 50 in the manner described hereinabove.

Figure 8:
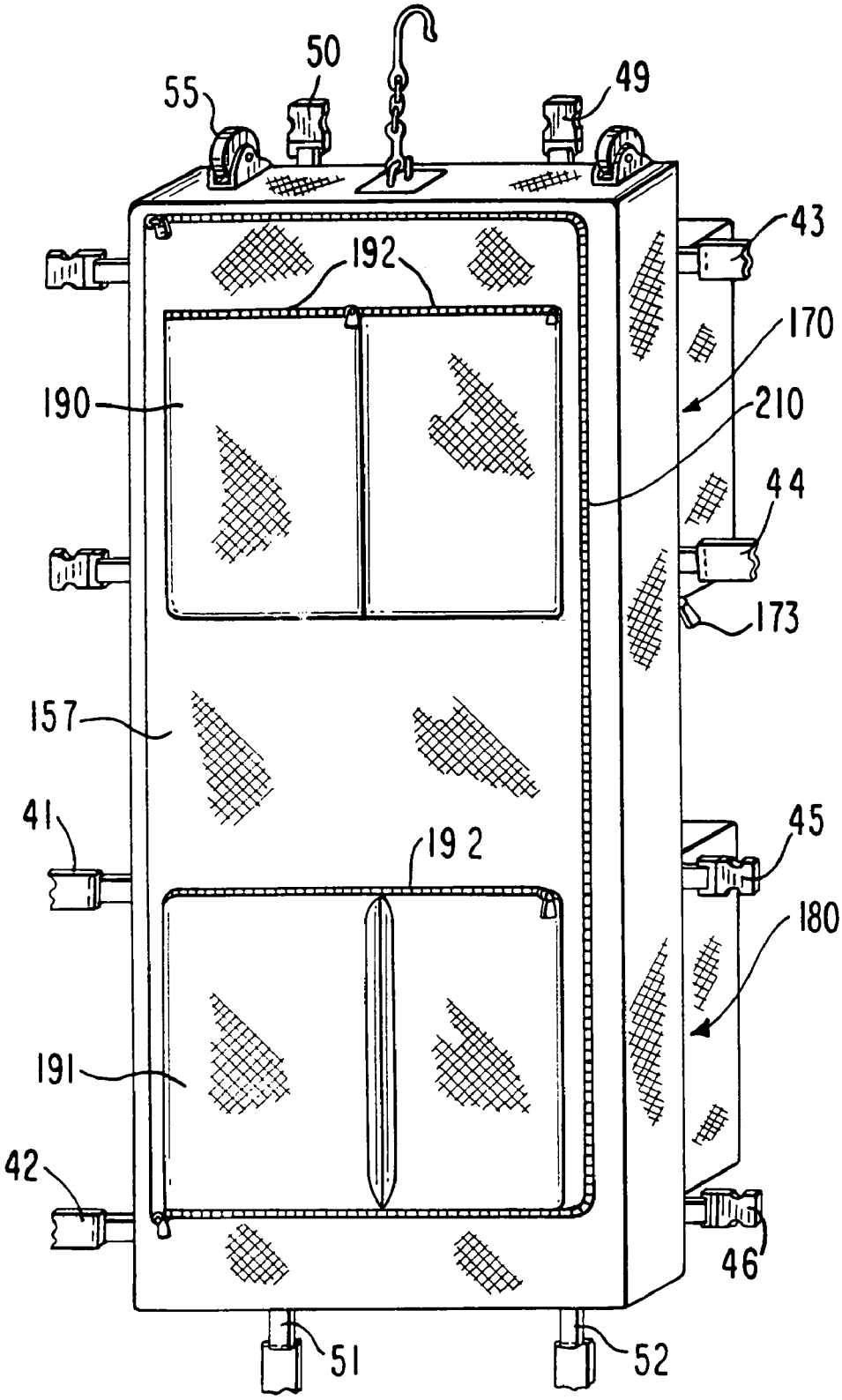
FIG. 8 is a perspective view of the outer garment carrier showing the zippered closure panel with integral pockets.

In lieu of the removable compartments 170, 180, permanent pouches 190, 191 with zippered closures 192, such as shown in FIG. 8 may be substituted.

The new luggage assembly may be made in various sizes as will be understood. However, for beneficial and optimized usage, the dimensions shown on the drawings have been established to be highly advantageous for the two luggage components making up the assembly. The proportions and relationships disclosed are enabling of the practice of the principles of the invention.

Although the foregoing description has been given by way of a preferred embodiment, it will be understood by those skilled in the art that other forms of the invention falling within the ambit of the following claims is contemplated. Accordingly, reference should be made to the following claims in determining the full scope of the invention.

I claim:

1. A nested wheeled luggage assembly comprising:

(a) an inner core luggage member hingeable about a central horizontal axis from an elongated deployed position for packing and retrieving garments to a compact closed position;

(b) said inner core luggage member including:

(c) two open storage shells hinged on said axis and selectively connectable about their peripheries; and at least one pair of support wheels and a retractable extendable handle being mounted on one shell whereby said core luggage member may be independently transported; and (d) an outer, wraparound garment carrier foldable about a central horizontal axis from an elongated deployed position for packing and retrieving garments to a compact closed position;

(e) said outer garment carrier including at least one pair of spaced support wheels and a telescopically retractable pull handle;

(f) said outer carrier being of equal width but substantially longer than said inner core luggage member, whereby said outer carrier may be folded over said core luggage member in closely engaging relation therewith;

(g) locking strap means deployed at the periphery of said outer carrier and adapted to secure said outer carrier in a folded relation over said core luggage member in a manner whereby said outer carrier and inner core luggage member may be transported as a single unit.

2. Compact luggage comprising (a) a first five-sided open parallelepiped clamshell element;

(b) a second five-sided open parallelepiped clamshell element;

(c) a hinge means connecting said first and second elements along a common axis for connecting said elements end-to-end;

(d) said elements being foldable along said axis into juxtaposition with their peripheral edges in contact;

(e) quick closure means selectively connecting said juxtaposed edges;

(f) removable five-sided foldable shelf means hinged to each of said elements for deployment into horizontal planes when said elements are suspended end-to-end;

(g) removable cord means limiting the movement of said removable five-sided shelf means; and (h) fastening means adapted to secure said removable shelf means to each other in a clamshell-closing position to establish a separate luggage unit.

* * * * *